US005682986A

United States Patent [19]

Cobler

[11] Patent Number: 5,682,986

[45] Date of Patent: Nov. 4, 1997

[54] CIGARETTE PACKAGE ASSEMBLY HAVING A PACKAGE AND A SLEEVE FOR SPENT CIGARETTES

[75] Inventor: Larry Douglas Cobler, Winston-Salem, N.C.

[73] Assignee: R. J. Reynolds Tobacco Company, Winston-Salem, N.C.

[21] Appl. No.: 196,825

[22] Filed: Feb. 15, 1994

Related U.S. Application Data

[63] Continuation of Ser. No. 938,983, Sep. 1, 1992, abandoned.

[51] Int. Cl.[6] ..... B65D 25/06

[52] U.S. Cl. ..... 206/265; 206/246

[58] Field of Search ..... 206/246, 259, 206/268, 265

[56] References Cited

U.S. PATENT DOCUMENTS

| | | | |
|---|---|---|---|
| 1,902,388 | 3/1933 | Welch | 206/246 |
| 2,148,319 | 2/1939 | Negbaur | 206/259 |
| 2,233,324 | 2/1941 | Palmer | 206/259 X |
| 2,254,608 | 9/1941 | Heyer | 206/259 |
| 2,435,826 | 2/1948 | Greene | 206/259 |
| 2,818,969 | 1/1958 | Klein | 206/259 |
| 3,018,878 | 1/1962 | Watkins | 206/246 |
| 3,096,878 | 7/1963 | Whitley et al. | 206/246 |
| 3,126,092 | 3/1964 | Maron | 206/246 |
| 3,404,770 | 10/1968 | Peery | 206/246 |
| 3,881,599 | 5/1975 | Flaherty | 206/273 |
| 3,888,264 | 6/1975 | Baclit | 131/235 R |
| 4,207,976 | 6/1980 | Herman | 206/246 |
| 4,252,237 | 2/1981 | Baclit | 206/86 |
| 4,534,463 | 8/1985 | Bouchard | 206/267 |
| 4,789,059 | 12/1988 | Kim | 206/246 |
| 4,807,745 | 2/1989 | Langley et al. | 206/245 |
| 4,886,161 | 12/1989 | Keldar et al. | 206/246 |
| 4,961,496 | 10/1990 | Focke et al. | 206/246 |
| 5,080,227 | 1/1992 | Focke | 206/273 |
| 5,139,140 | 8/1992 | Burrows et al. | 206/268 |

FOREIGN PATENT DOCUMENTS

| | | |
|---|---|---|
| 435809 | 7/1991 | European Pat. Off. . |
| 454003 | 10/1991 | European Pat. Off. . |

OTHER PUBLICATIONS

European Search Report dated Dec. 28 , 1993.

*Primary Examiner*—B. Dayoan

[57] ABSTRACT

A cigarette package assembly includes a hinged lid package and a sleeve. The sleeve fits over the package and is movable relative to the package. Cigarettes are removed from the package and smoked. Spent cigarettes then are inserted into an insertion region in the sleeve. The sleeve can be removed from the package, and spent cigarettes can be disposed of. Then, the package and the sleeve can be re-assembled.

8 Claims, 8 Drawing Sheets

CIGARETTE PACKAGE ASSEMBLY HAVING A PACKAGE AND A SLEEVE FOR SPENT CIGARETTES

This is a continuation of application Ser. No. 938,983 filed on Sept. 1, 1992, now abandoned.

BACKGROUND OF THE INVENTION

The present invention relates to a package assembly for smoking articles, such as cigarettes.

Popular smoking articles, such as cigarettes, conventionally have been sold in packages. Typically, each package contains about 20 or about 25 cigarettes.

One type of popular cigarette package is the so-called "hard-pack," "crush proof box" or "hinged lid package." Such a package has a generally cuboid-type shape, is manufactured from resilient paperboard, and includes an outer wrap of transparent polypropylene film. Hinged lid cigarette packages conventionally are made from two paperboard blanks. One blank forms the body and lid of the package. The second blank forms an insert or inner frame which is assembled to the inside of the front and side walls of the package. The inner frame projects above the front and side walls of the package body, and provides a seal between the lid and body when the package is closed. See, for example, U.S. Pat. No. 4,852,734 to Allen, et al. Other types of designs of blanks for hinged lid cigarette packages can be of the type described in U.S. Pat. Nos. 3,874,581 to Fox, et al., 3,944,066 to Niepmann, and 5,139,140 to Burrows et al.

Cigarettes also can be packaged in a container having the form of a so-called "soft pack." See, for example, U.S. Pat. Nos. 3,695,422 to Tripodi and 4,717,017 to Sprinkel, Jr., et al. Cigarettes are removed from a soft package by tearing away a portion of the top of the package, in order that cigarettes can be easily accessed from the top of the package.

Certain new cigarettes; especially those of the type described in U.S. Pat. Nos. 4,714,882 to Banerjee et al.; 4,756,318 to Clearman et al.; 4,793,365 to Sensabaugh, Jr. et al.; 4,854,331 to Banerjee et al; 4,881,556 to Clearman et al and 5,027,837 to Clearman et al.; and U.S. patent application Ser. Nos. 723,350, filed Jun. 28, 1991 and 873,529 filed Apr. 21, 1992, now U.S. Pat. No. 5,183,062; tend to maintain essentially all of their original length during and after smoking. As such, efficient disposal of such spent or smoked cigarettes is clearly desirable. A receptacle for immediate disposal of spent cigarettes when suitable refuse containers are not readily available is clearly desirable. A suggested package for certain new types of cigarettes has been proposed in U.S. Pat. No. 4,961,496 to Focke et al.

It would be highly desirable to provide a cigarette package assembly which can contain cigarettes and also provide a temporary receptacle for spent or smoked cigarettes.

SUMMARY OF THE INVENTION

The present invention relates to a package assembly for smoking articles, such as cigarettes. The package assembly includes a package for smoking articles and a complementary sleeve or shell capable of providing for the disposal of the spent smoking articles described above, namely, cigarettes which tend to maintain essentially all of their original length during and after smoking. The package and sleeve each are interconnecting, are movable relative to one another, can be separated from one another, and can be reassembled to form the package assembly.

The package most desirably includes a body portion and a lid portion which is integrally hinged to the body portion. The body portion includes a front wall, a bottom wall, a rear wall, inner side walls and outer side walls. The lid portion includes a front wall, a top wall, a rear wall integrally hinged to the rear wall of the body portion, inner side walls and outer side walls.

In a preferred aspect, the top wall of the package includes (i) a removable panel or portion, and (ii) a stationary portion which remains with the package during the useful lifetime of the package. The package also includes a movable top flap positioned between the removable top panel and the cigarettes within the package. The top flap is positioned such that it can be opened to allow removal of cigarettes from the package, and then closed. As such, the package can be employed as a conventional hinged lid package, or in a manner similar to a soft package (i.e., so as to gain access to the cigarettes through the top of the package).

The packages of the present invention are manufactured from suitable blanks (e.g., paperboard blanks) in much the same manner as are conventional hinged lid cigarette packages, filled with cigarettes using conventional cigarette packaging technology, and overwrapped with outer wrap as is conventional in the cigarette packaging art.

The present invention also relates to an assembled sleeve or shell which is designed to fit over at least a portion of the bottom, top, front and back walls, and one side wall of the hinged lid package. The shell includes an insertion region in at least one wall thereof, most preferably in either the front or back wall thereof, preferably extending along substantially the full height of that wall, and preferably adjacent to the side wall thereof. The insertion region allows spent cigarettes to be inserted into the shell and be contained in the space formed between the inside region of the shell and the adjacent side wall of the cigarette package.

The shell can be adapted so as to slide over one side of the cigarette package, be held in place by friction fit, and slidable so as to allow spent cigarettes to be inserted into the insertion region. The shell also can be adapted so as to include an extension/connection tab which preferably extends from the bottom wall of the shell, and preferably is fixedly secured (e.g., adhesively bonded) to the bottom region of the cigarette package.

The preferred package assembly of the present invention includes the desirable features of the popular hinged lid package design, as well as a complementary sleeve or shell which provides for a disposal region for spent cigarettes. That is, the preferred package, once initially opened, is fully recloseable after each successive cigarette is removed therefrom so as to (i) protect cigarettes contained therein, and (ii) minimize the loss or spillage of cigarettes from the opened package. In addition, the preferred package includes the desirable features of a soft package. That is, the preferred package, once initially opened, can be employed in a manner such that each successive cigarette can be easily accessed and removed from the package without opening the entire hinged lid portion. Furthermore, cigarettes can be removed from the preferred package without the necessity of entirely removing the sleeve or shell from the package, when that package is opened to remove each successive cigarette therefrom for use. Once smoked, spent cigarettes can be inserted into the insertion region for storage. When desired by the smoker, the package can be separated from the sleeve to allow for disposal of spent cigarettes into a waste basket or other suitable refuse container. Then, the package and sleeve can be recombined for further use.

DETAILED DESCRIPTION OF THE PREFERRED EMBODIMENTS

Figure 1:
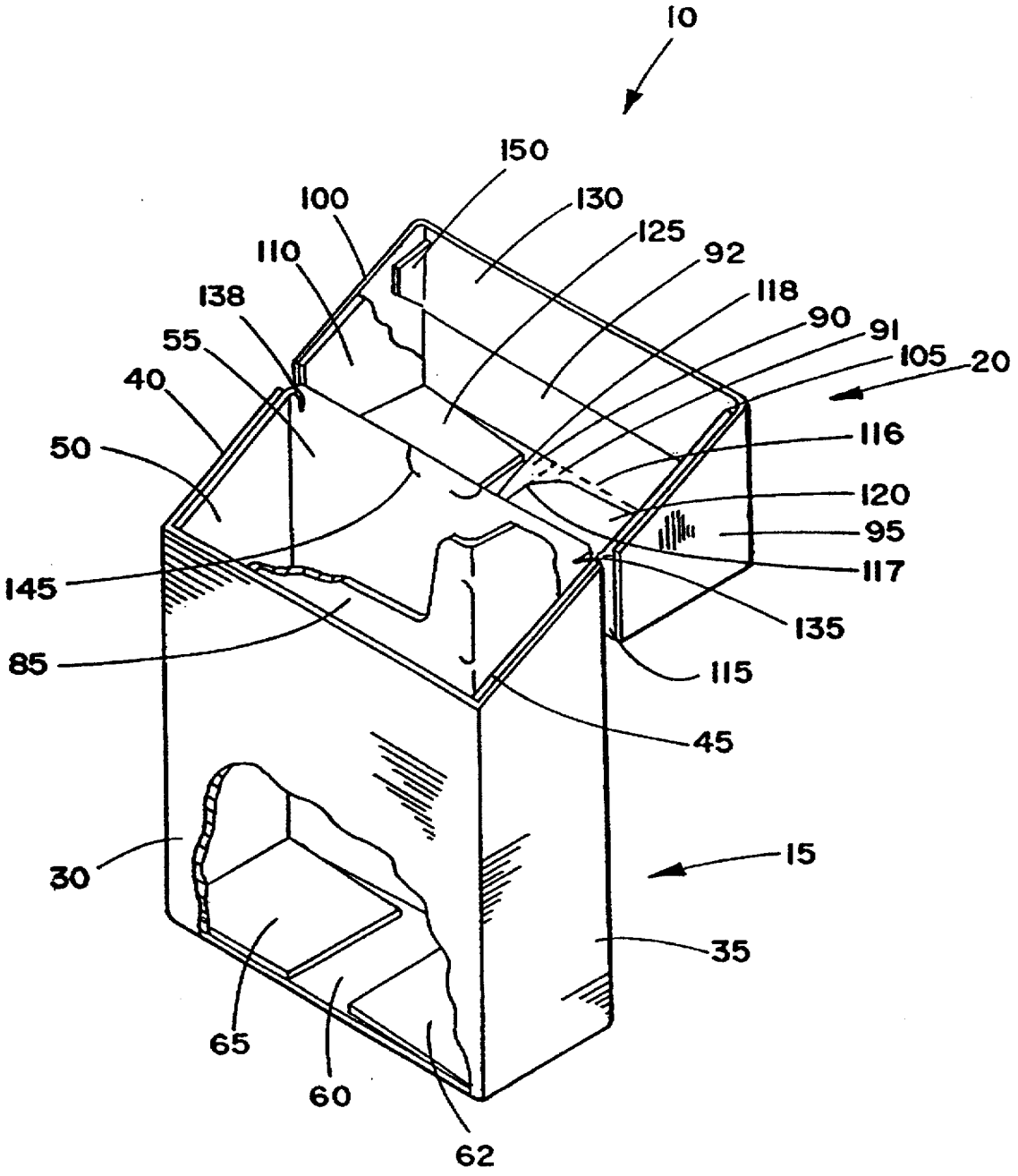
FIG. 1 is a perspective of a representative assembled hinged lid package of the invention in one type of open position.

Referring to FIG. 1, a representative assembled hinged lid package of cigarette box 10 includes a body portion 15 and a lid portion 20. The package has a generally rectilinear shape when viewed from the bottom thereof.

The body portion includes a front wall 30 (shown as partially cut away), right outer side wall 35, left outer side wall 40, inner side walls 45 and 50, rear wall 55, bottom wall 60, and bottom flaps 62 and 65. The upper edges of the inner and outer side walls of the body of the package can extend from the front of the package to the back thereof at an upward incline of about 30 degrees, or any other desired angle. Generally, the inner and outer side walls of each side of the body are of similar shape and dimension. An inner liner or collar 85 (shown as partially cut away) is glued or otherwise secured to the inner surface of a portion of the front wall 30 and the inner side wall 45 and 50. Packages having integral inner liners can be employed, if desired.

The lid portion 20 includes a stationary top wall portion 90, removable top wall portion or panel 91, front wall 92, outer side walls 95 and 100, inner side wall 105 and inner side wall 110 (shown as partially cut away), and rear wall 115 which is integrally hinged to rear wall 55 of the body 15. The lower edges of the inner and outer side walls of the lid of the package can extend from the front of the package to the back thereof at an upward incline of about 30 degrees, or any other desired angle. Generally, the inner and outer side walls of each side of the lid are of similar shape and dimension. The removable top wall or panel 91 is removed (as described in greater detail hereinafter) by tearing that panel along perforation lines 116 and 117.

Hinge 118 has the form of a crease, fold or score line across the rear wall of the box. The lid portion also includes top flaps 120 and 125, and reinforcing panel 130. Top flap 120 is a movable flap which can be moved so as to open and close the box, as described in greater detail hereinafter. The movable top flap 120 is attached to the remaining package through lid inner side wall 105, and top flap 120 is movable about a creased line along the top flap and the inner side wall. As such, the top flap 120 is movable about a hinge formed by the crease separating the top flap from the inner side wall. The box 10 also can include optional tear minimizers 135 and 138, and stress reliever 145 in the region of hinge 118; as is common in conventional hinged lid package manufacture.

Tab 150 is integrally connected to one side of the lid reinforcing panel 130, and extends between lid outer side wall 100 and lid inner side wall 110 (shown as cut away). In particular, a fold between the reinforcing panel and the tab 150 allows the tab to fit between the two side wall portions. A similar tab (not shown) is connected to the opposite side of the lid reinforcing panel, and is fit between lid outer side wall 95 and lid inner side wall 105. See, also U.S. Pat. No. 4,852,734 to Allen, et al., which is incorporated herein by reference.

The hinged lid or crush proof package conveniently is secured together by applying adhesive material to the outer surfaces of inner walls 45, 50, 105 and 110. application of adhesive to the inner surface of the lid reinforcing panel is optional when tabs integrally connected to the lid reinforcing panel are present. Adhesives used in the construction of the package will be apparent to the skilled artisan. The package can include printed indicia indicating brand identification and directions for using the package.

Figure 2:
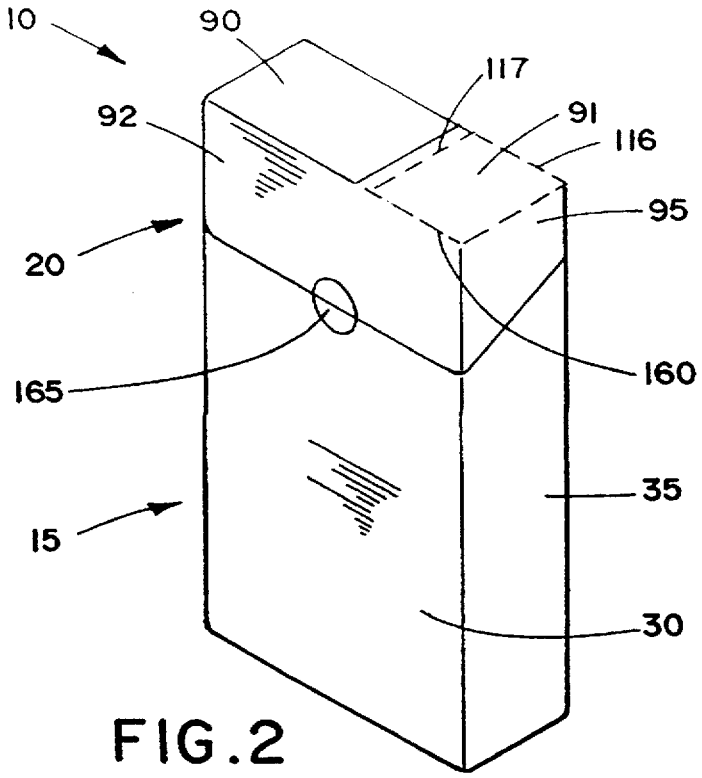
FIG. 2 is a perspective of a representative assembled hinged lid package of the invention in a closed position.

Referring to FIG. 2, package 10 includes a stationary top wall 90, and a top panel 91 which is removable therefrom. The package includes only 2 essentially rectangular shaped top wall portions or panels, and each portion is positioned at opposite sides of the package separated by perforation line 117. The removable top panel 91 is removed by tearing that panel from the package along perforation lines 116, 117 and 160. The perforations can be provided by a series of straight or angled nicks or cuts which are positioned end-to-end. The perforation lines are between the removable top panel and (i) the lid front wall, (ii) the stationary panel, and (iii) the lid rear wall. As such, the top flap 120 is exposed and stationary top wall portion 90 remains with the package when the removable top panel is torn away. In addition, adhesive seal 165 positioned between the front lid and body walls can act to maintain the lid in a closed position, but be easily broken to allow the package to be opened by moving the lid about the hinge 118 between the lid and body portions.

Figure 3:
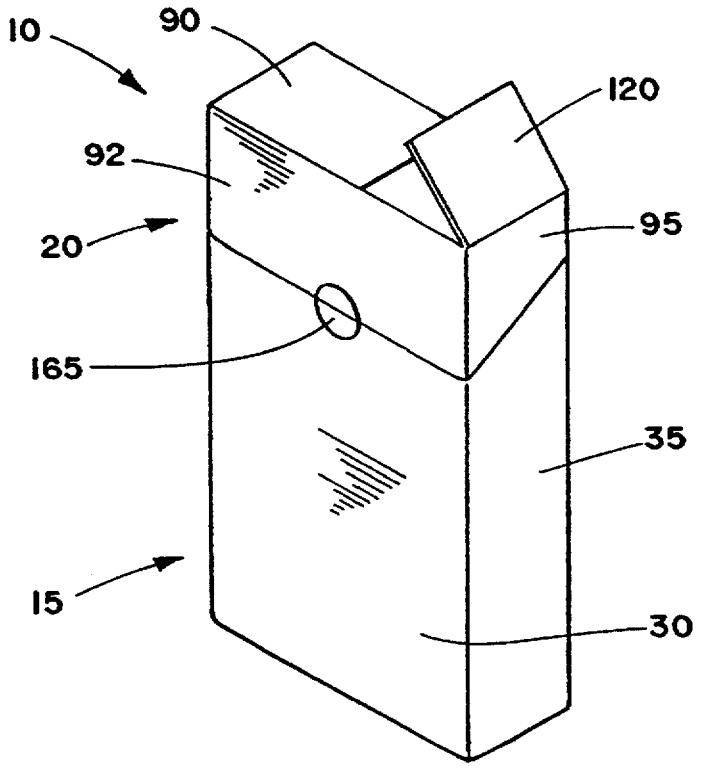
FIG. 3 is a perspective of a representative assembled package of the invention in one type of open position.

As shown in FIG. 3, the recloseable top flap 120, which is exposed after top panel 91 is removed and discarded, can be opened to expose inner wrapping material and cigarettes within the package. The package can be opened by the smoker by flipping the flap out with his/her fingers or by squeezing the top sides of the package. The top flap 120 then can be closed such that a portion of the top flap fits underneath stationary top wall portion 90. As such, the package can be opened either as a conventional hinged lid package, or using the recloseable top flap.

The body and lid of the packages shown in FIGS. 1 through 3 conveniently are provided using known techniques and equipment from blanks of the type which described in U.S. Pat. No. 5,139,140 to Burrows et al., which is incorporated herein by reference. The blanks so described can be assembled into packages containing cigarettes using cigarette packaging machines available as GDX2 from G.D. S.P.A. and 350 S from Focke & Co.

Figure 4:
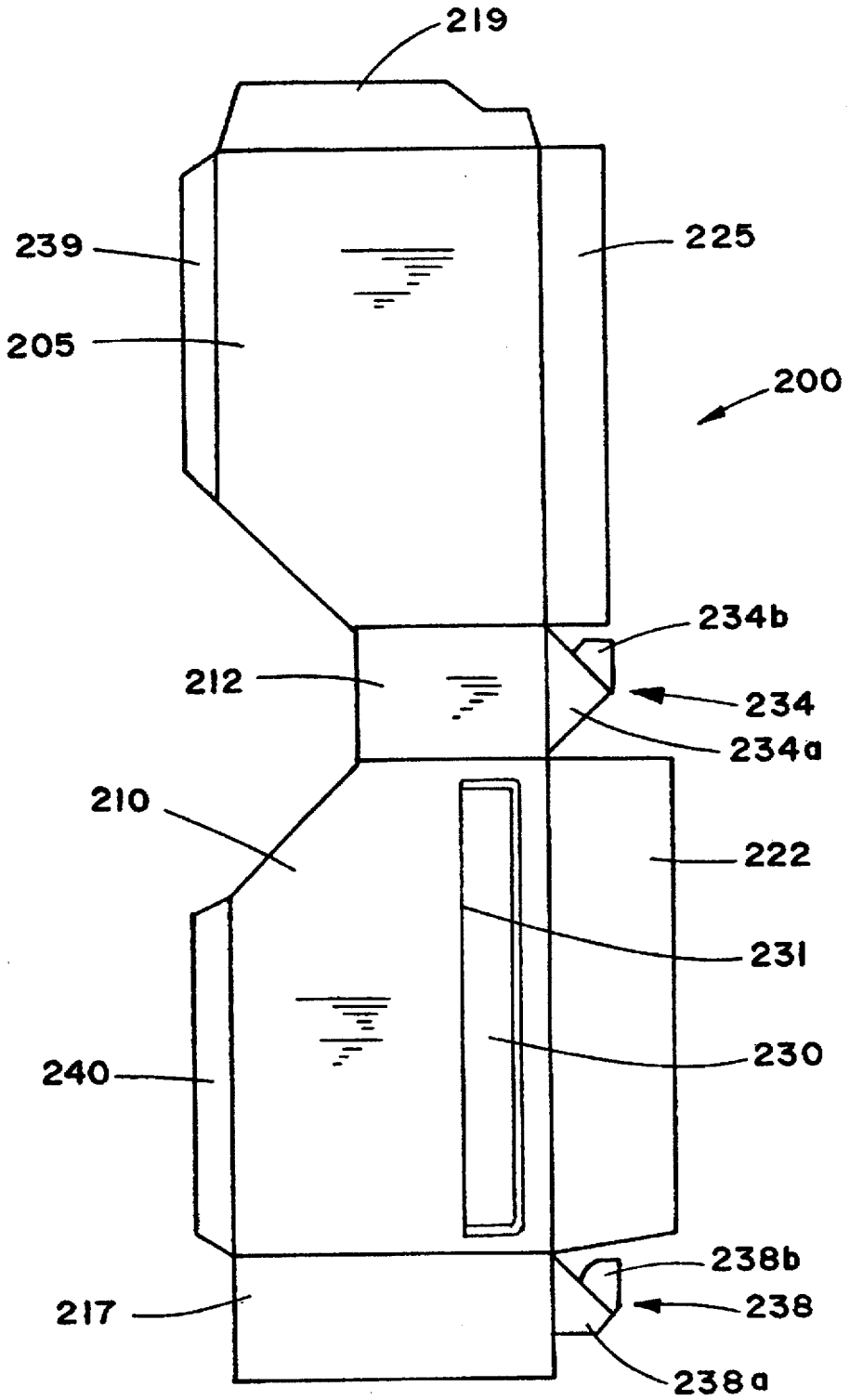
FIGS. 4 and 6 are diagrammatic schematic, approximate scale illustrations of blanks for the manufacture of sleeves for cigarette package assemblies of the present invention.
Figure 5:
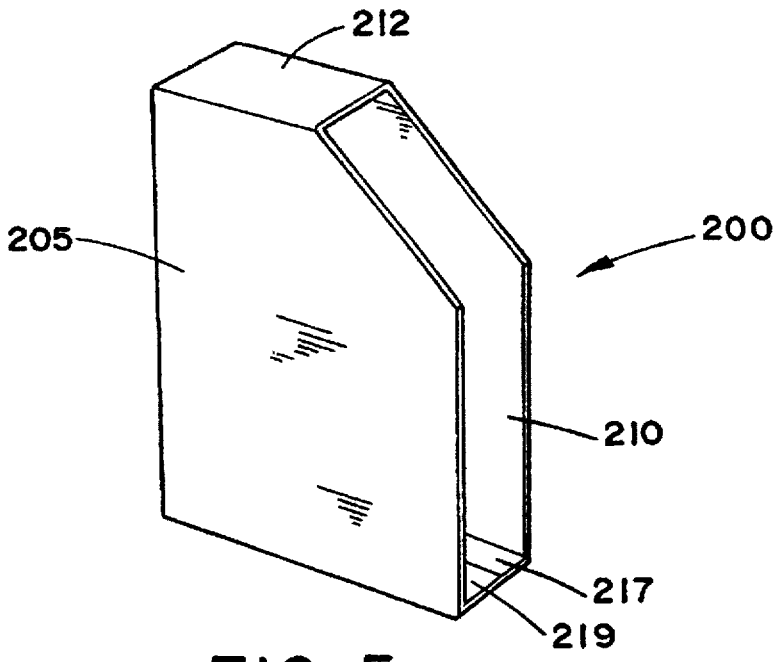
FIGS. 5 and 7 are perspectives showing sleeves assembled from the blanks shown in FIGS. 4 and 6, respectively.

Referring to FIGS. 4 and 5, blanks for package shells or sleeves are shown. Those blanks most preferably are provided from a paperboard sheet, and include a plurality of fold lines, creases and score lines (shown as solid lines in FIGS. 4 and 5); perforations (shown as dotted lines in FIGS. 4 and 5); and a plurality of cuts. The cuts are made by slitting the blanks without removal of material therefrom; however, for illustration purposes, the slit lines are shown in FIGS. 4 and 5 as narrow slots.

Referring to FIG. 4, blank 200 includes a front panel or wall 205, a back wall 210, a top wall 212, bottom outer wall 217, bottom inner wall 219, left side outer wall 222 and left side inner wall 225. The back wall 210 includes a cut region which defines insertion region 230 for spent cigarettes. Typically, the insertion region is defined by a first slit provided by slitting the blank along the substantial length of the back wall 210 (which length of the first slit typically is slightly longer than that of the spent cigarette to be inserted into the insertion region), and by two further slits provided by slitting the blank at each end of the first slit (which further slits are at right angles to the first slit, and each further slit having a length which is slightly greater than that of the width of a spent cigarette to be inserted into the insertion region). As such, a movable flap is provided about crease 231. As such, the insertion region 230 has a length and width which are overall comparable to that of such spent cigarettes, and allow for effective insertion of such spent cigarettes therethrough. If desired, a second insertion region (not shown) can be similarly positioned in front wall 205, or the insertion region can be positioned in the front wall 205 rather than in the back wall 210. If desired, it is possible for the insertion region to be in another of the walls of the sleeve, such as the top wall or bottom wall (e.g., so that spent cigarettes can be inserted down or up into the insertion region).

Figure 4A:
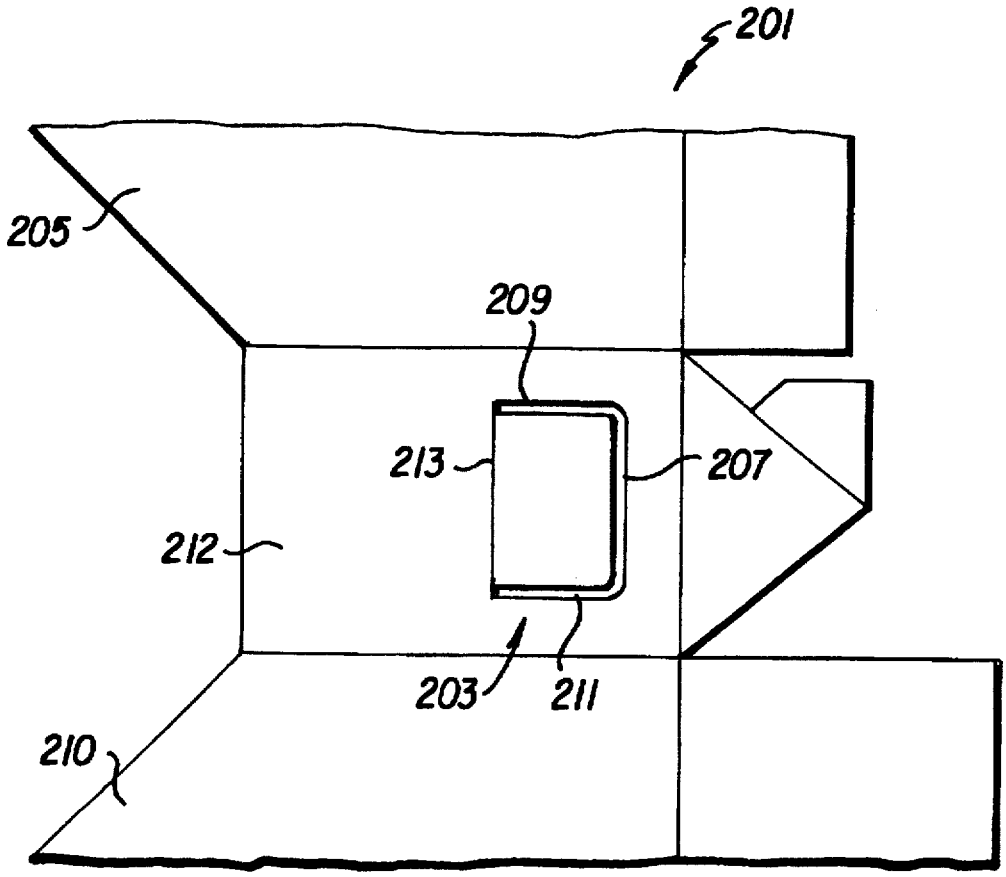
FIG. 4*a* is a fragmentary plan view of a blank for the manufacture of sleeves for cigarette package assemblies of the present invention.

FIG. 4*a* illustrates a fragmentary portion of a sleeve blank 201 identical to blank 200 except that the insertion region 203 is located in the top wall 212 of the sleeve rather than in the back wall 210 of the blank. The insertion region 203 is defined in the same manner as the insertion region 230 of blank 200, namely, by a first slit 207 and by two further slits 209, 211 provided by slitting the blank at each end of the first slit 207 at right angles to the first slit 207. Also, as in blank 200, a movable flap is provided about crease 213. Spent cigarettes may be inserted down into the insertion region 203 when the blank 202 is folded into the sleeve form similar to that shown in FIG. 5.

The blank 200 also includes a top tab 234 and a bottom tab 238 integral with and to one side of top wall 212 and outer bottom wall 217, respectively. Tabs 234 and 238 (each of which are composed of two parts, 234*a, b* and 238*a, b*, respectively) are used to help maintain the assembly blank in an assembled configuration. Although not preferred, the blank can include optional flaps 239 and 240 at the respective sides of side walls 205 and 210.

Blank 200 which is shown in FIG. 4 can be constructed into a shell or sleeve so as to provide the assembled sleeve shown in FIG. 5. In particular, a suitable adhesive is applied to the outer surface of bottom inner wall 219 so as to secure that wall to the inner surface of bottom outer wall 217. Suitable adhesive is applied to the inner surface of tabs 234*b* and 238*b* so as to secure those tabs to the outer surfaces of walls 225 and 222, respectively. As such, tabs 234 and 238 are positioned in order to allow the assembled sleeve to be folded flat for handling purposes, without disassembly, and then readily opened to provide the resulting assembled sleeve unit. As such, the blank is constructed into a five sided shell having front and back walls, top and bottom walls, and left side wall. The optional security flaps, which are shown in FIG. 4, are not shown in FIG. 5.

Figure 6:
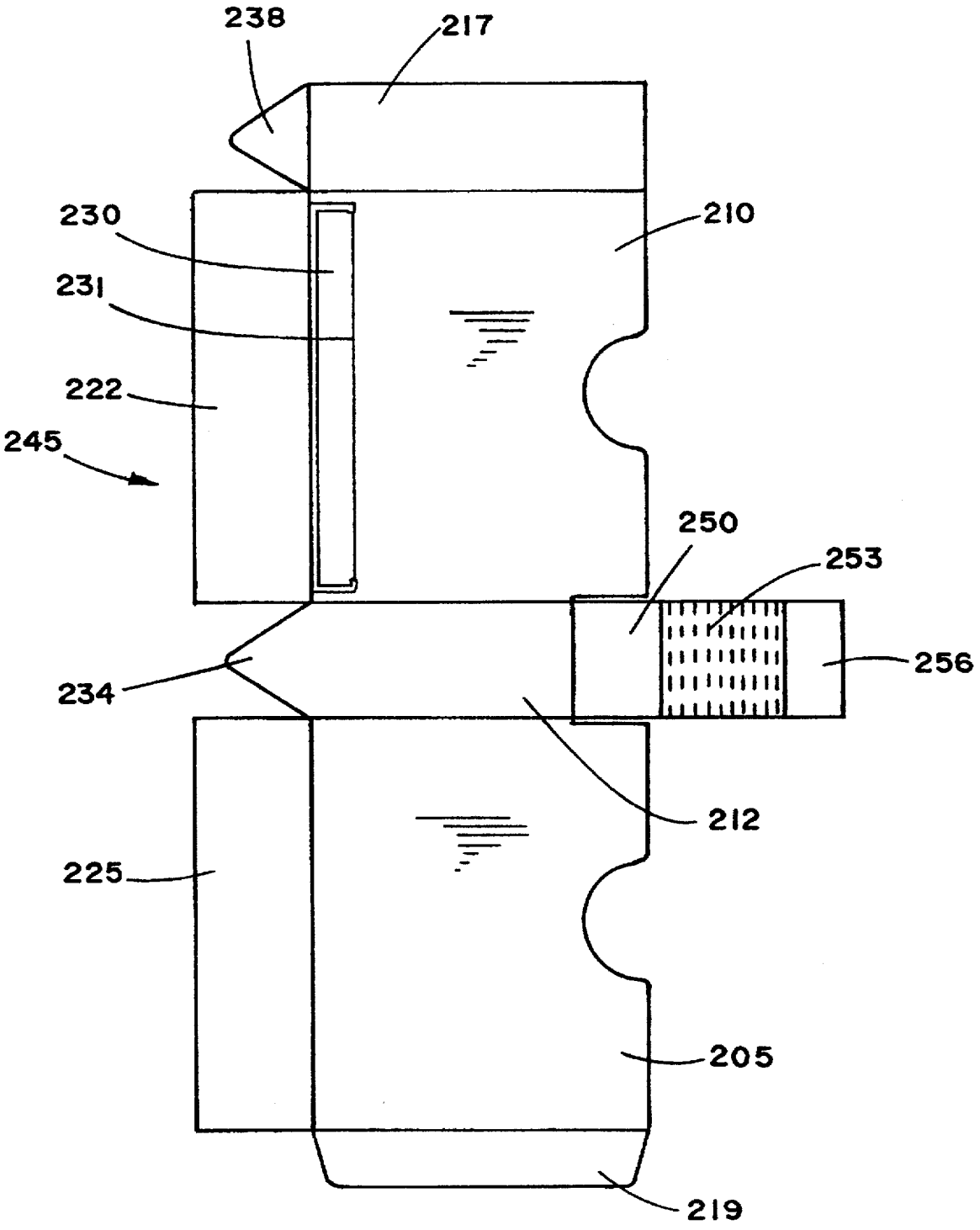

Referring to FIG. 6, blank 245 is generally similar to that blank described with reference to FIG. 4. However, the bottom wall 212 includes an extension/connection tab 250 integral with and to one side of the bottom wall. The extension/connection tab 250 includes a perforation region 253 and an end connection region 256 for adhesive connection to the bottom portion of the cigarette package which is employed therewith.

Figure 7:
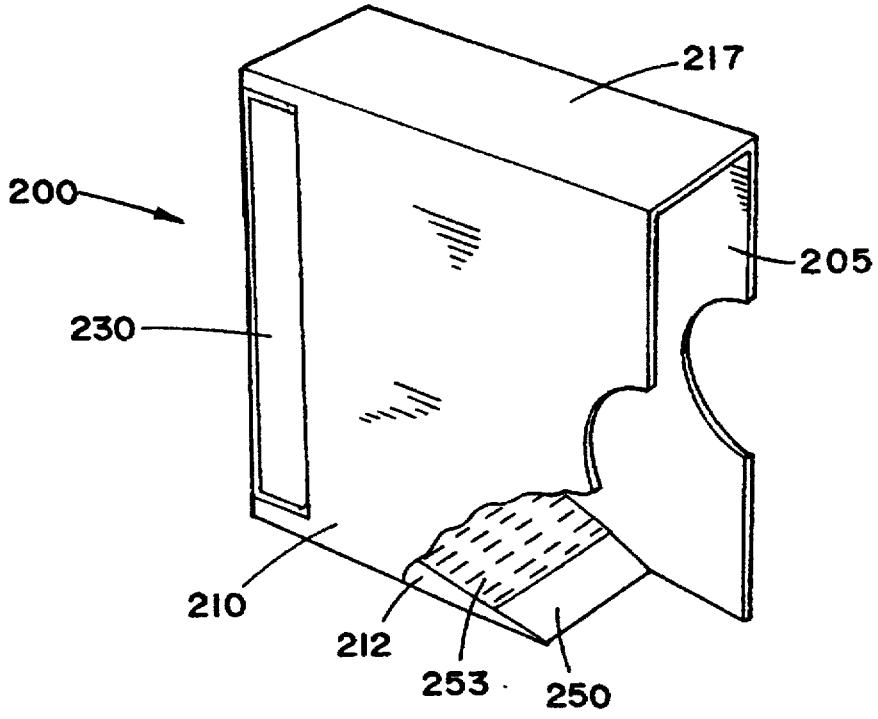

Blank 245 which is shown in FIG. 6 can be constructed into a shell or sleeve so as to provide the assembled sleeve shown in FIG. 7. In particular, a suitable adhesive is applied to the outer surface of bottom inner wall 219 so as to secure that wall to the inner surface of bottom outer wall 217. Adhesive also is applied to the inner surface of outer wall 225 and to the outer surface of inner wall 222 so as to secure the sleeve in an assembled configuration. In addition, tabs 234 and 238 are positioned inside of the assembled sleeve. As such, the blank is constructed into a five sided shell having front and back walls, top and bottom walls, and left side wall. Front wall 210 is shown as partially cut away. The shell also includes an extension/connection tab extending from the end of the bottom wall opposite the left side wall. Portion or segment 250 of the tab is folded back and tacked using suitable adhesive to the bottom inner face 212 of the sleeve.

Figure 8:
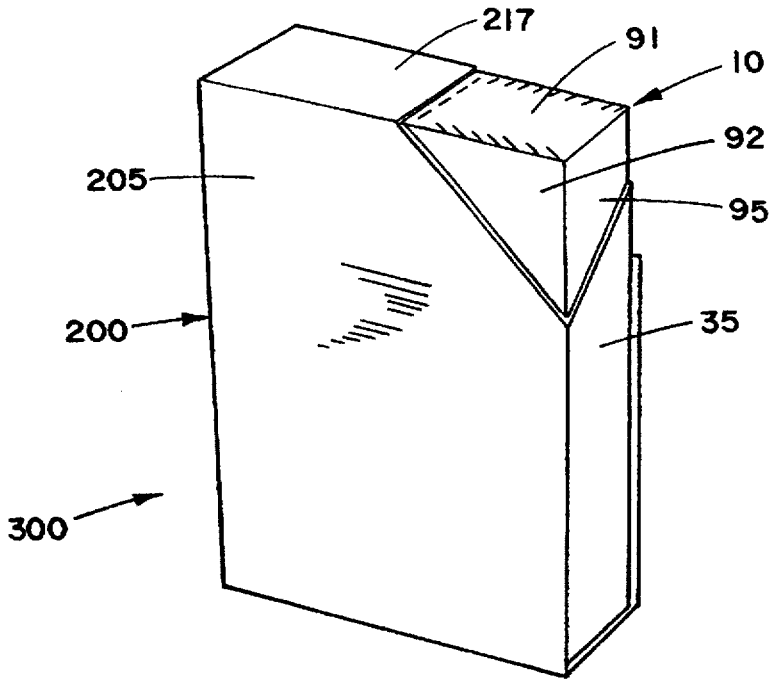
FIG. 8 is a perspective showing the front and top region of a cigarette package assembly of the present invention.

Referring to FIG. 8, there is shown a cigarette package assembly 300 including a cigarette package 10 and an assembled package shell 200. The shell 20 fits securely over the package 10 so as to expose the right side of the package and the top right region of the package. As such, cigarettes can be removed from the package conveniently after the removable top wall panel 91 is torn away. The shell can be held in place by friction fit; moved such that the inner left wall of the shell fits flush (i.e., in contact with) the left wall of the package; moved such that a void space is located between the inner left wall of the shell and the outer left wall of the package; or totally removed or separated from the package so as to not contact the package.

Figure 9:
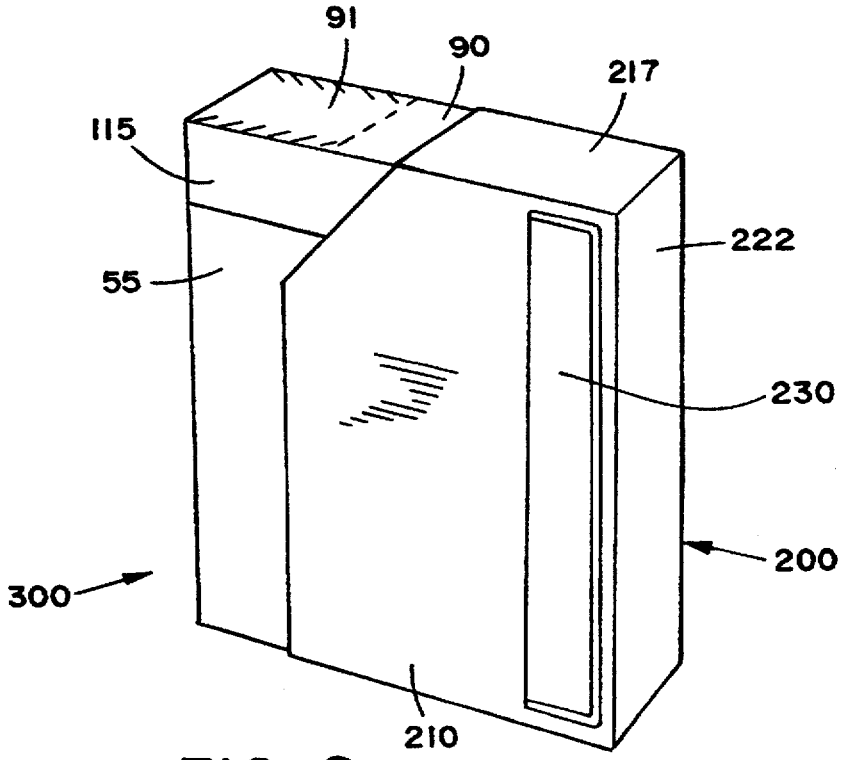
FIG. 9 is a perspective showing the back and top region of a cigarette package assembly of the present invention.

Referring to FIG. 9, there is shown the cigarette package and assembled package shell assembled as shown in FIG. 8. However, the left wall of the package shell is shown as moved slightly away from the left wall of the cigarette package in order that a spent cigarette can be inserted into the insertion region 230 of the package shell. Individual cigarettes can be removed from the package by opening top flap 120 of the package; and after each cigarette is smoked, each spent cigarette is inserted into the insertion region of the package shell, after the shell has been moved slightly away from the outer left wall of the package. In such a manner, several (e.g., usually up to about 6) spent cigarettes can be disposed of in the void space between the package and the sleeve. When the smoker desires, the sleeve can be removed from contact with the package, and the spent cigarettes in the sleeve are disposed of into a suitable receptacle. Then, the empty sleeve and the partially full package can be recombined to form the cigarette package assembly.

Figure 10:
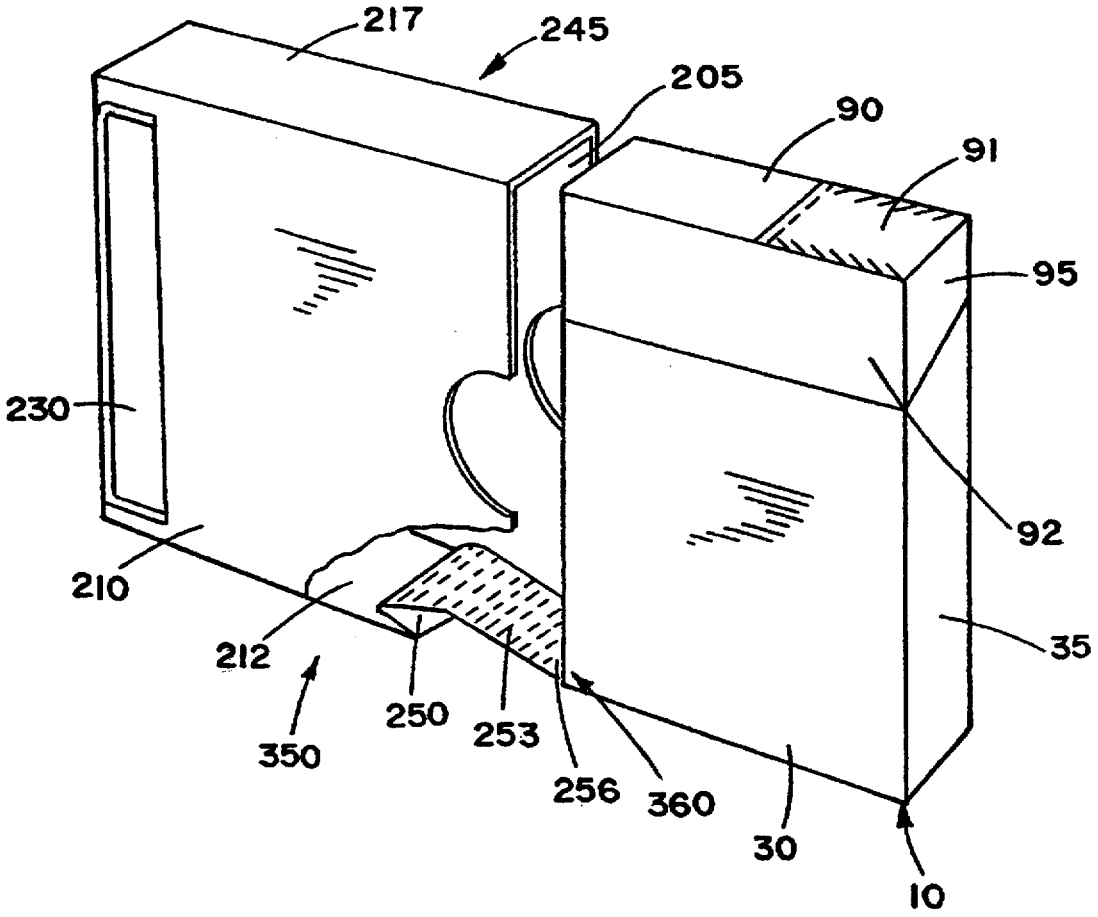
FIG. 10 is a perspective showing a representative sleeve and a representative cigarette package in an attached form but in a disassembled configuration.

Referring to FIG. 10, there is shown a cigarette package assembly 350, including a cigarette package 10 and an assembled package shell 245. The cigarette package assembly is shown in an assembled fashion but in an open form. The front wall 210 of the sleeve is shown as partially cut away. In particular, the end connection region 256 of the package shell is adhered to the bottom region 360 of the left side wall of the package. The connection region of the sleeve preferably is movable such that the package can be readily removed from inside the sleeve and repositioned inside the sleeve. The package can be moved relative to the sleeve in order that spent cigarettes can be inserted into the insertion region 310 of the package shell. When the package is removed from the sleeve to dispose of spent cigarettes contained in the sleeve, the sleeve and package remain connected using the connection region in order that the package can be readily inserted back into the sleeve.

The cigarette packages shown in FIGS. 9 and 10 are of the type described with reference to FIGS. 1 through 3; however, it is possible to employ cigarette packages of a conventional type, particularly for the type of cigarette package assembly described with reference to FIG. 10.

Each cigarette package blank can be assembled into a cigarette package containing cigarettes using techniques and equipment known to the skilled artisan. Typically, 20 cigarettes are contained within each package (e.g., in a 7-6-7 or 7-7-6 configuration), along with conventional package insert materials (e.g., paper/foil laminate inner packaging material) in a manner readily apparent to the skilled artisan. Normally, the cigarettes are packaged such that the filter end or mouthend of each cigarette essentially abuts the inner portion of the top of the package; however, the cigarettes also can be packaged such that the lighting end or tobacco end of each cigarette essentially abuts the inner portion of the top of the package and the filter end is positioned in the bottom of the package. If desired, the inner paper/foil laminate material which covers the cigarettes within the package can be perforated or otherwise provided so as to be torn away easily, particularly when the package is opened by tearing away the removable top panel and opening the top flap.

Each package then is overwrapped using an outer wrapping material, such as cellophane, polypropylene film, the metallized material described in European application Publication No. 454,003; or the overwrapping materials described in U.S. Pat. Nos. 4,807,745 to Langley, et al. and 4,947,994 to Newsome. The overwrapping material for each package preferably includes a tear tape, which is provided using known techniques. The tear tape can be positioned so as to circumscribe the package (i) in the region just below or near the bottom of the hinged lid (as is common for conventionally wrapped hinged lid packages); (ii) aroumd the center center region of the lid portion; or (iii) near the extreme top of the package (as is common for conventionally wrapped soft packages).

An example of a representative embodiment of the invention is an assembled hinged lid package having a height of about 85 mm, a width of about 55 mm and a depth of about 23 mm. The package is manufactured from resilient, durable paperboard (e.g., a low density solid bleached sulfate paperboard) having a thickness of 0.012 inch and a paperboard inner liner so as to have the configuration shown in FIGS. 1 through 3. The removable panel has dimensions of about 23 mm by about 24 mm. The top flap has dimensions of 23 mm by about 20.5 mm. When the blank is assembled into a package, the top flap extends under the top wall about 1.5 mm so that the flap can maintain a closed relationship, but easily be clicked open to expose the cigarettes in the package. The sleeve is manufactured from similar paperboard, is manufactured from the blank shown in FIG. 4, and has dimensions so as to fit over (i) the bottom and left side of package, (ii) the front wall except for the top right hand corner, (iii) the back wall except for the top corner, (iv) top wall except for the top right side. In addition, the sleeve includes an insertion region of about 83 mm length and about 10 mm wide in the back wall spaced about 5 mm from the left wall thereof.

What is claimed is:

1. A cigarette package assembly comprising a sleeve and a package containing a plurality of cigarettes, each cigarette having an axis and an original length which remains substantially the same after the cigarette is spent by smoking, said package comprising a rectangular parallelepiped having a front, back, top, bottom and two side walls, each wall having a length and width, the widths of the top, bottom and two side walls being equal and being the smallest dimension of the parallelepiped, the lengths of the top and bottom walls and the widths of the front and back walls being equal and being greater than the smallest dimension of the parallelepiped, the lengths of the front, back and two side walls being equal and being the greatest dimension of the parallelepiped, said sleeve having front, back, top, and bottom walls corresponding to a respective front, back, top, and bottom wall of the package and one side wall corresponding to one of the two side walls of the package, said package being slidable into and movable relative to said sleeve such that the respective front, back, top, and bottom walls of the sleeve and package confront one another and are slidable relative to one another, the one side wall of the sleeve confronting one of the two side walls of the package and being movable toward and away from said one side wall of the package to form a receptacle space defined by the top, bottom, front, back, and side wall of the sleeve and the one side wall of the package confronted by the side wall of the sleeve, said receptacle space having one dimension equal to or greater than the original length of the cigarettes, an insertion region in one wall of the sleeve for inserting into said receptacle space a spent cigarette having a length along its axis substantially equal to its original length, said insertion region being dimensioned and arranged relative to said one dimension of the receptacle space such that said spent cigarette is insertable through said insertion region and into said receptacle space with its axis arranged substantially parallel to said one dimension of the receptacle space.

2. The package assembly of claim 1, wherein the insertion region is positioned in the back wall of the sleeve.

3. The package assembly of claim 2, wherein the insertion region comprises a flap defined by an elongated slit having opposite ends and extending substantially parallel to the length of the back wall and two further slits arranged to intersect the elongated slit at the opposite ends thereof, the flap being movable about a hinge formed by a crease extending between the two further slits.

4. The package assembly of claim 3, wherein the insertion region has a length of about 83 mm.

5. The package assembly of claim 1, wherein the insertion region is positioned in the front wall of the sleeve.

6. The package assembly of claim 5, wherein the insertion region comprises a flap defined by an elongated slit having opposite ends and extending substantially parallel to the length of the front wall and two further slits arranged to intersect the elongated slit at the opposite ends thereof, the flap being movable about a hinge formed by a crease extending between the two further slits.

7. The package assembly of claim 6, wherein the insertion region has a length of about 83 mm.

8. The package assembly of claim 1, wherein the insertion region is positioned in the top wall of the sleeve such that spent cigarettes inserted into the receptacle space are positioned therein with the axes thereof arranged substantially parallel to the axes of the cigarettes in the package.

* * * * *